US006401953B2

(12) United States Patent
Kofod

(10) Patent No.: US 6,401,953 B2
(45) Date of Patent: Jun. 11, 2002

(54) COLLAPSIBLE CONTAINER FOR TRANSPORTING A LIQUID

(75) Inventor: Bent Kofod, Kalundborg (DK)

(73) Assignee: Carrimor, Hadersler (DK)

( * ) Notice: Subject to any disclaimer, the term of this patent is extended or adjusted under 35 U.S.C. 154(b) by 0 days.

(21) Appl. No.: 09/864,325

(22) Filed: May 25, 2001

Related U.S. Application Data

(63) Continuation of application No. PCT/DK99/00657, filed on Nov. 25, 1999.

(51) Int. Cl.[7] ..... B65D 90/62

(52) U.S. Cl. ..... 220/7; 220/1.6; 220/1.5; 220/6; 220/826; 220/819

(58) Field of Search ..... 220/817, 818, 220/819, 826, 833, 1.6, 1.5, 7, 6, 4.28

(56) References Cited

U.S. PATENT DOCUMENTS

| | | | | |
|---|---|---|---|---|
| 3,635,368 A | | 1/1972 | Winsor | 220/6 |
| 4,173,289 A | * | 11/1979 | Nesti | 220/1.5 |
| 4,662,532 A | | 5/1987 | Anderson et al. | 220/1.5 |
| 4,735,331 A | | 4/1988 | Keenan et al. | 220/6 |
| 4,911,317 A | * | 3/1990 | Schloesser et al. | 220/1.5 |
| 5,056,667 A | | 10/1991 | Coogen | 206/600 |
| 5,265,748 A | * | 11/1993 | Furukawa | 220/1.5 |
| 5,398,835 A | * | 3/1995 | Blinstrub | 220/7 |
| 5,474,197 A | | 12/1995 | Hillis et al. | 220/6 |
| 5,890,612 A | * | 4/1999 | Coppi | 206/600 |
| 6,044,998 A | * | 4/2000 | Schearer et al. | 206/600 |

FOREIGN PATENT DOCUMENTS

| | | |
|---|---|---|
| DE | 32 00 216 A1 | 8/1982 |
| DE | 38 20 999 A1 | 1/1989 |
| GB | 868455 | 5/1961 |
| GB | 2 170 183 A | 7/1986 |
| WO | WO 87/06213 | 10/1987 |
| WO | WO 93/04952 | 3/1993 |
| WO | WO 93/23315 | 11/1993 |
| WO | WO 97/31832 | 9/1997 |

OTHER PUBLICATIONS

International Search Report, PCT/DK 99/00657, dated Feb. 18, 2000.
Danish Search Report for Application PA 1988 01554, dated Aug. 12, 1999.

* cited by examiner

*Primary Examiner*—Stephen Castellano
(74) *Attorney, Agent, or Firm*—Pennie & Edmonds LLP

(57) ABSTRACT

A collapsible container for storing and transporting a liquid having a substantially rectangular base section, two end sections and two opposite side sections pivotally connected to each their respective side of the four sides of the base section, a top section pivotally connected to a side section or an end section, and a liner for storing the liquid. The sections are arranged to pivot in relation to each other between a first position in which they in rows are extending mainly parallel across each other and a second position in which they jointly are defining a chamber for containing the liner. The collapsible container has a locking mechanism to lock the end sections and the side sections together in the second position in such a way that they in this position only can be pivoted in over the base section.

9 Claims, 17 Drawing Sheets

COLLAPSIBLE CONTAINER FOR TRANSPORTING A LIQUID

CROSS-REFERENCE TO RELATED APPLICATIONS

This application is a continuation of the U.S. National Phase designation of co-pending International Patent Application No. PCT/DK99/00657, filed Nov. 25, 1999, the entire content of which is expressly incorporated herein by reference thereto.

FIELD OF THE INVENTION

The invention relates to a collapsible container for transporting a liquid. In particular the invention relates to a container having a substantially rectangular base section, two opposite end sections and two opposite side sections. Each of the side and end sections are pivotally connected to one of the four sides of the base section. The collapsible container also has a top section pivotally connected to a side section or an end section, and a liner for storing the liquid The sections are arranged to pivot in relation to each other between a first position in which they in rows are extending mainly parallel across each other and a second position in which they jointly are defining a chamber for containing the liner.

BACKGROUND OF THE INVENTION

The transport of liquid takes place to a great extent in transportable reusable receptacles that often are filled in one place and emptied at another. The emptied receptacles obviously weigh less than the full ones, but the space they occupy is the same when the containers are noncolapsable such as with steel tanks. These noncolapsable receptacles are therefore costly and difficult to return when they have to be filled again.

To deal with this problem, liquid containers have been devised that after emptying the container, it can then be made to assume a highly reduced volume. These containers each consist of a flexible liner in form of a large bag and a box with detachable walls for by means of fittings being assembled around the liner and support it on all sides. When the liner is empty, the box can be disassembled after which the loose walls can be stacked on top of each other and the liner laid flat. In the disassembled state, the container occupies relatively little space. However, the process of assembling and disassembling the box is time-consuming and difficult.

In order to facilitate this task, liquid containers have since been devised that are hinged on a pallet-like base frame.

When the liner has been emptied, the walls can then be collapsed in over the base frame quickly and easily, and when the liner is to be filled, the walls can be put up just as easily again to form a stable box around the liner. As the walls of this design can be swung in over the base frame, it is however very difficult for an assembler to put up the liner which typically has a threaded flange that is fastened in a base opening made in the base frame.

SUMMARY OF THE INVENTION

The object of the invention is to provide a container of the kind mentioned in the opening paragraph that is designed in such a way that the liner can be put up in the container more easily and quickly than currently known.

The novel and unique features according to the invention, which achieve this objective, is that the collapsible container has locking means such that in a second position locking the end sections and the side sections together in such a way that they only can be pivoted in over the base section. Furthermore, at least one of the end sections is constructed as a door section that consists partly of a frame connected pivotally about a swivelling axis to the base section and partly of at least one door connected pivotally about a second swivelling axis to the frame.

The locking means ensure that the container in the second position, that is in raised state, can resist the outwardly directed pressure of the liquid in a full liner. However, the special design of the door section still allows the door to be opened outwardly so that an assembler can easily and conveniently gain access to put up the liner.

The above locking means can advantageously consist of cooperating stops disposed on the end sections and the side sections, respectively. In this case, the stops of the end sections can be in form of a bolt with a shank and a head, and the stop of the side sections can be in form of a locking plate with a slot. These stops can be arranged in such a way that the shank of the bolt will be in the slot and its head behind the locking plate when the respective sections are in their second position. This allows the side sections and the ends to mutually secure each other against the pressure of the liquid in a full liner.

The stops on the end section can conveniently be arranged as a U fastened with the legs to the inside of the respective side section whereby the bottom of the U forms the locking plate with the slot.

In an especially simple and advantageous embodiment according to the invention, the frame of the door section can be shaped as an L with a first leg mounted pivotally about a horizontal swivelling axis on the base section and a second leg connected pivotally about a second swivelling axis to the door by means of hinges. At the same time, the stop of the door section can be disposed partly on the second leg of the L-shaped frame, partly on the lateral edge of the door opposite this second leg.

Having this structure, the door can be opened by at first swinging the entire door section at an appropriate angle inwardly about its horizontal swivelling axis. This results in a sufficient clearance to allow the door to subsequently be swung outwardly about the second swivelling axis and pass the corresponding stops on the side sections. When the frame of the door section subsequently is swung up again to upright position, the door can now be closed in a normal way by swinging about a horizontal swivelling axis.

When the side sections and the end sections are put up, they must be put in a position in which they are mainly perpendicular to the base section. The task of raising the container is facilitated when said position is locked by means of stops, mounted on the base frame and extending a distance up along the exterior of the respective sections.

As mentioned above, the end and side sections are locked together mutually in raised position by means of their cooperating stops. When the top section is pivotally fitted on the side section adjoining the second leg on the L-shaped frame of the door section, the top section can advantageously be locked together with both end and side sections. When the container is in the position of use, the sections thus lock one another together to an integrated unit that can resist the pressure of the liquid in a full liner.

When the end sections and the side sections are connected each pivotally about a horizontal swivelling axis to the base section, and the swivelling axis of the side sections is farther from the base frame than the swivelling axis of the end sections, the side sections will lie on top of the end sections when the container is collapsed. When the container is raised from this position, the side sections are consequently put up first after which the end sections are put up between the upright side sections.

The base section can advantageously be constructed as a pallet arranged to be lifted by a fork-lift truck. This pallet can furthermore have a bottom for supporting the full liner which typically has a threaded connecting piece led out through an opening in the container. When this opening is located under the door section, the assembler can, in the easiest way possible, assemble the threaded connecting piece of the liner via the door which can be opened in the way described above according to the invention.

BRIEF DESCRIPTION OF THE DRAWINGS

The invention will be explained in greater detail below, describing only exemplary embodiments with reference to the drawing, in which.

DETAILED DESCRIPTION OF THE PREFERRED EMBODIMENTS

In the following, it is assumed that the container according to the invention is intended for storing and transporting a liquid which during this is in a liner in form of a large bag of e.g. plastic. The full liner is in itself not dimensionally stable, and it is therefore supported along its entire exterior by a total of six solid walls pivotally connected to each other and in unfolded state forming a closed box with a chamber for keeping the liner.

Figure 1:
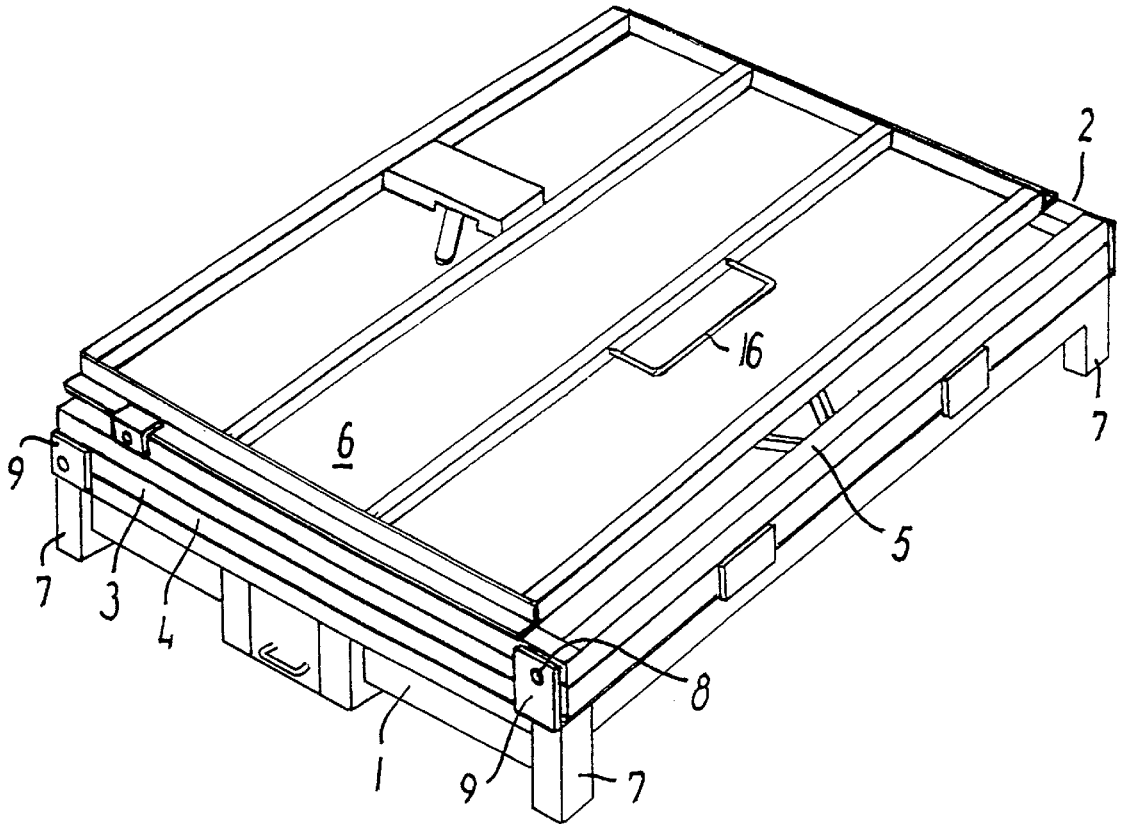
FIG. 1 is a perspective view of a collapsible container according to the invention with a base frame and walls folded in over the base frame.

When the liner has been emptied, these walls can, as shown in FIG. 1, be collapsed so that they will lie stacked on top of each other. In this collapsed state, the container occupies relatively little space, and it can therefore now be returned in a convenient and economically advantageous manner to be filled again.

The six walls of the container are, given in succession from below, a base frame 1, a back end 2, a front end 3, a left and right respectively, seen in the figure, side wall 4 and 5, and a top wall 6.

The base frame is constructed as a pallet with legs 7 allowing for insertion of the fork arms of a fork-lift truck (not shown) under the base frame so that the fork-lift truck can lift the container.

The side walls 4 and 5 are with swivel pins 8 pivotally journaled in bearing brackets 9 mounted on the leg 7 of the base frame 1.

Figure 2:
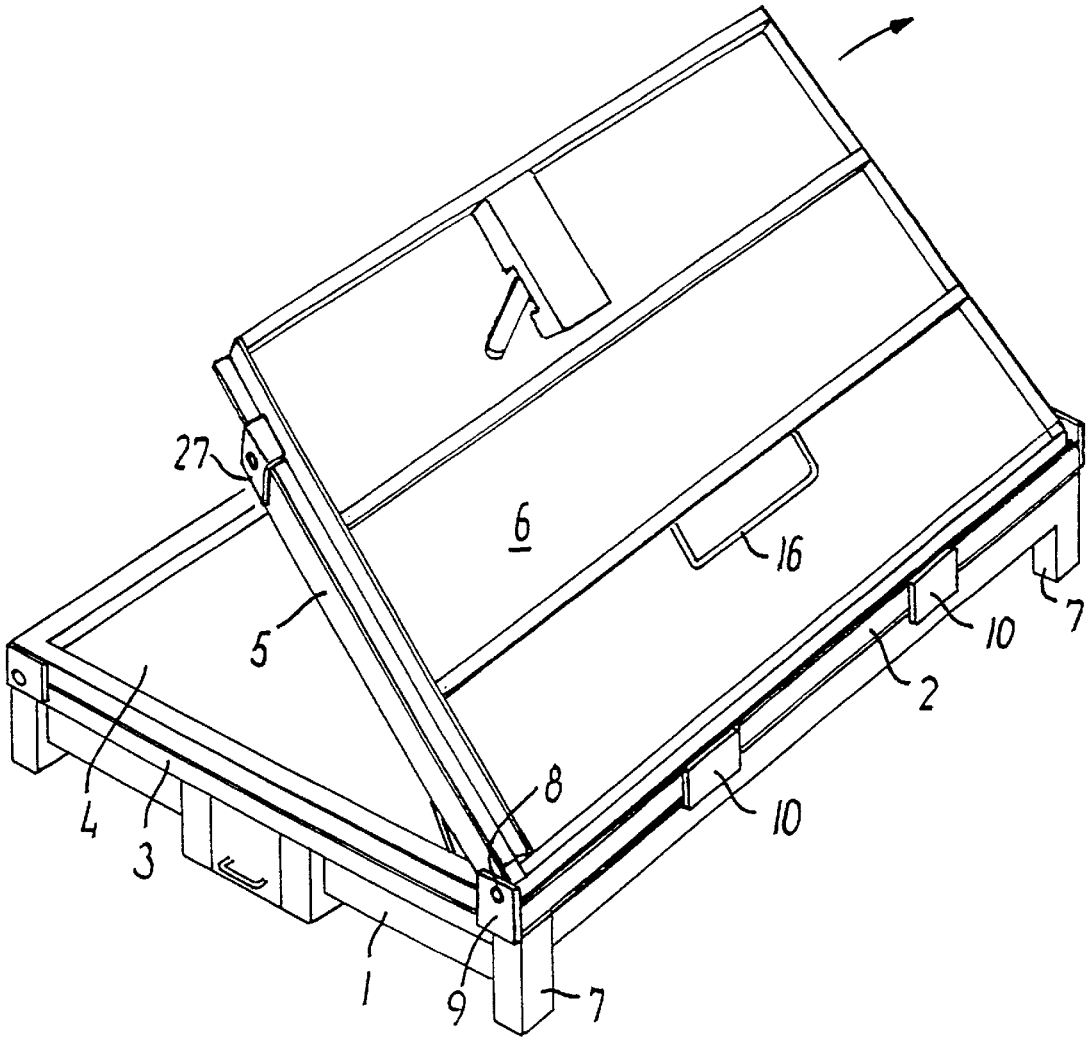
FIG. 2 shows the collapsible container in FIG. 1 in a first unfolding phase.
Figure 3:
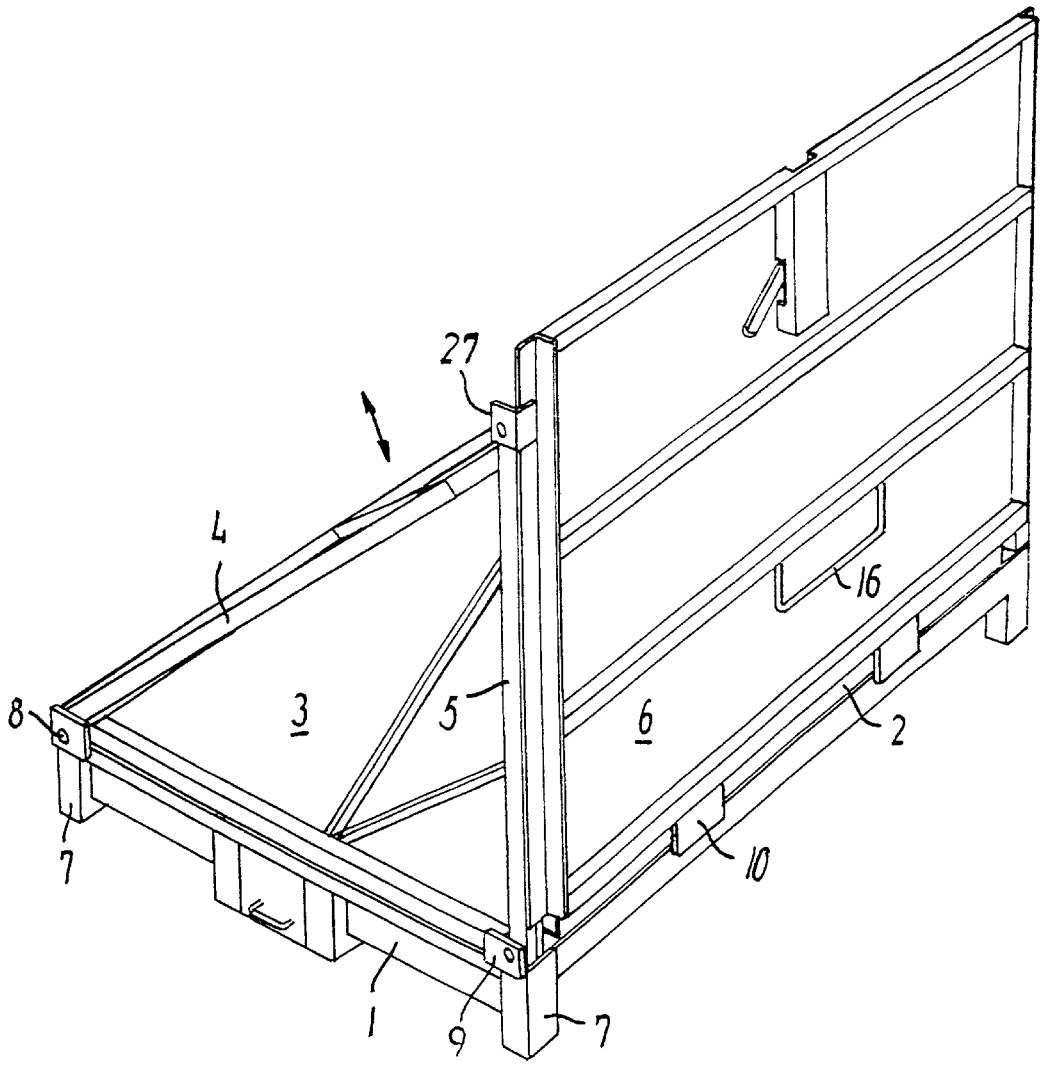
FIG. 3 shows the collapsible container in FIG. 1 in a second unfolding phase.

In FIG. 2, the operation of unfolding the container has just begun, the right side wall 5 now being swung in the direction of the arrow from the horizontal position in FIG. 1 to the upright position in FIG. 3 in which the side wall 5 is perpendicular to the base frame 1. Two pivot stops 10 fastened on the base frame 1 and extending a short distance across the exterior of the bottom part of the side wall 5 in the upright position of this wall serve for fixing this position so that the side wall does not tilt.

Figure 4:
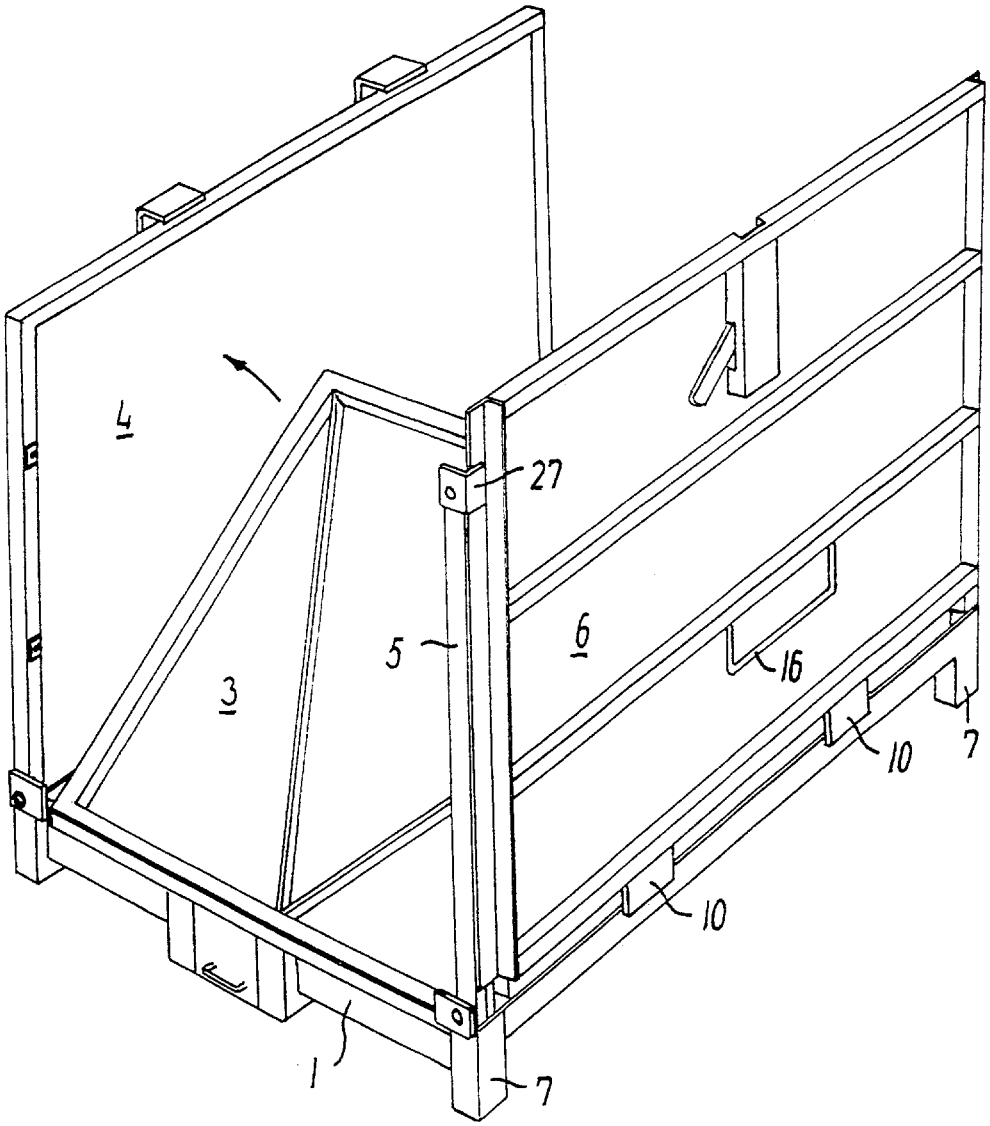
FIG. 4 shows the collapsible container in FIG. 1 in the third unfolding phase.

In FIG. 3, the left side wall 4 is swung in a similar way in the direction of the shown arrow from its horizontal position to the upright position in FIG. 4 in which the wall is fixed by means of pivot stops 10 (not shown in FIGS. 3 and 4).

Figure 5:
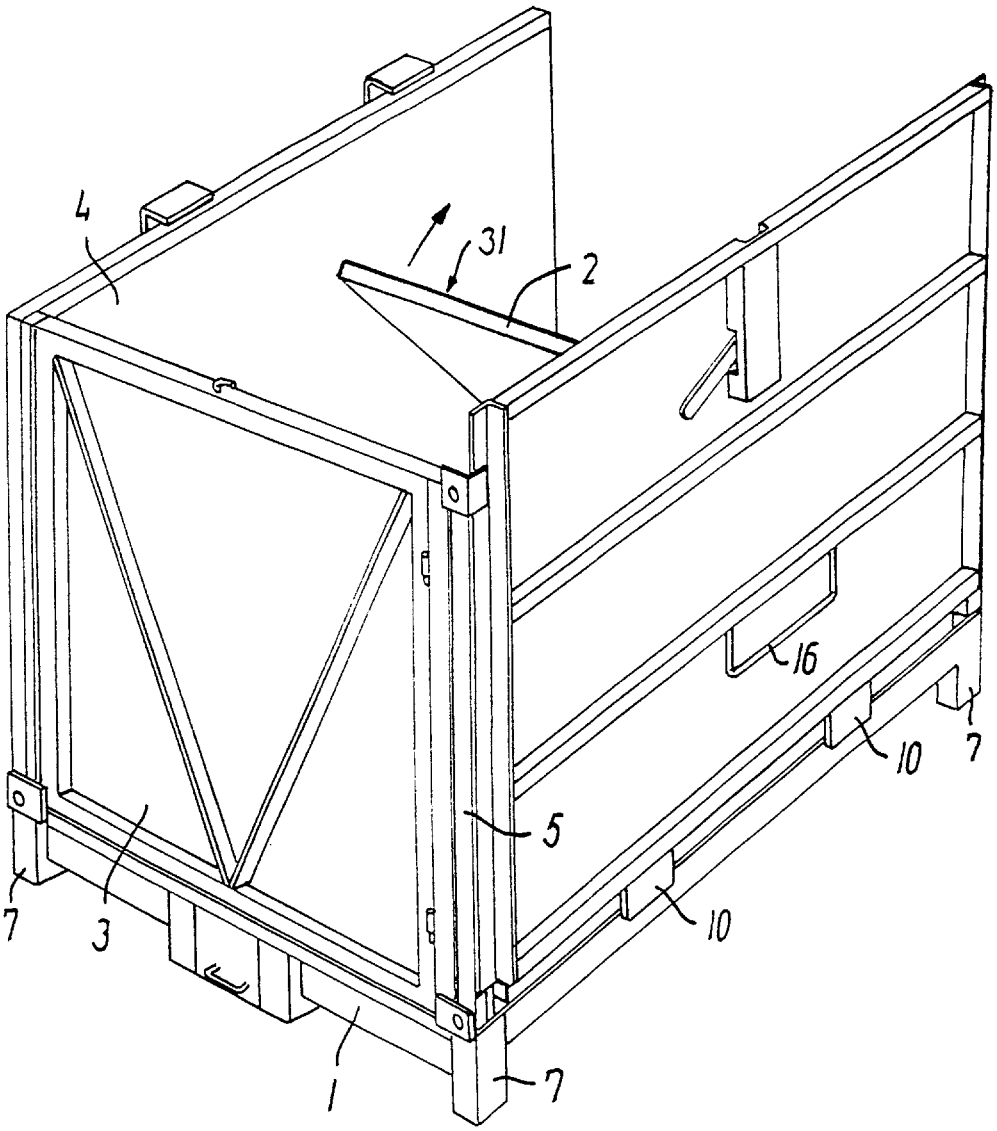
FIG. 5 shows the collapsible container in FIG. 1 in a fourth unfolding phase.

In FIG. 4, there is now enough room for the front end 3 to be swung in the direction of the arrow to the upright position in FIG. 5 which is fixed by bearing brackets 9 extending a short distance across the exterior of the bottom part of the end. The back end 2, as shown in FIG. 5, can then in a similar way be swung in the direction of the arrow to the upright position in FIG. 6 in which it is fixed by bearing brackets 9 (not shown in FIGS. 5 and 6), just as the front end.

As it can be seen from FIGS. 6, 7 and 8, the top wall 6 is pivotally connected to the right side wall 5 in a way which is described in detail below with further reference to FIGS. 9 and 10.

Figure 9:
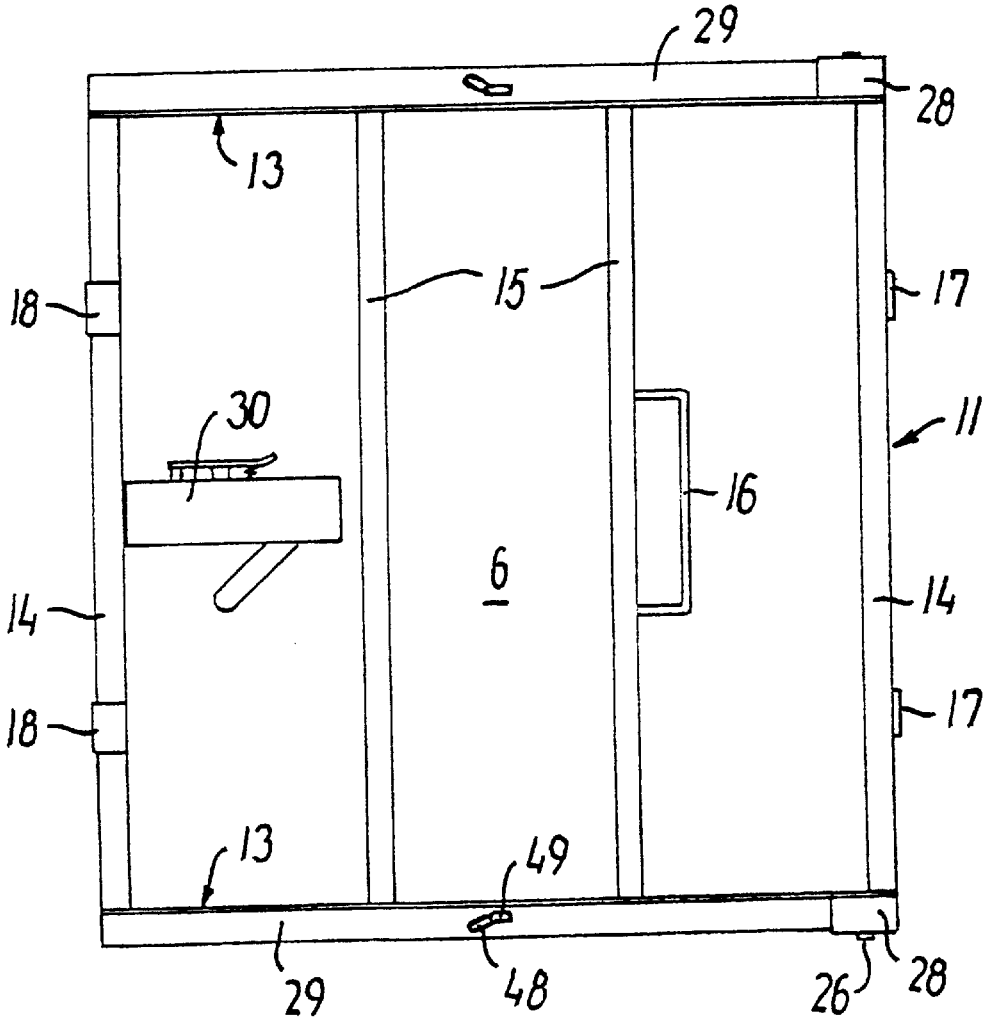
FIG. 9 is a plan view of the container.
Figure 10:
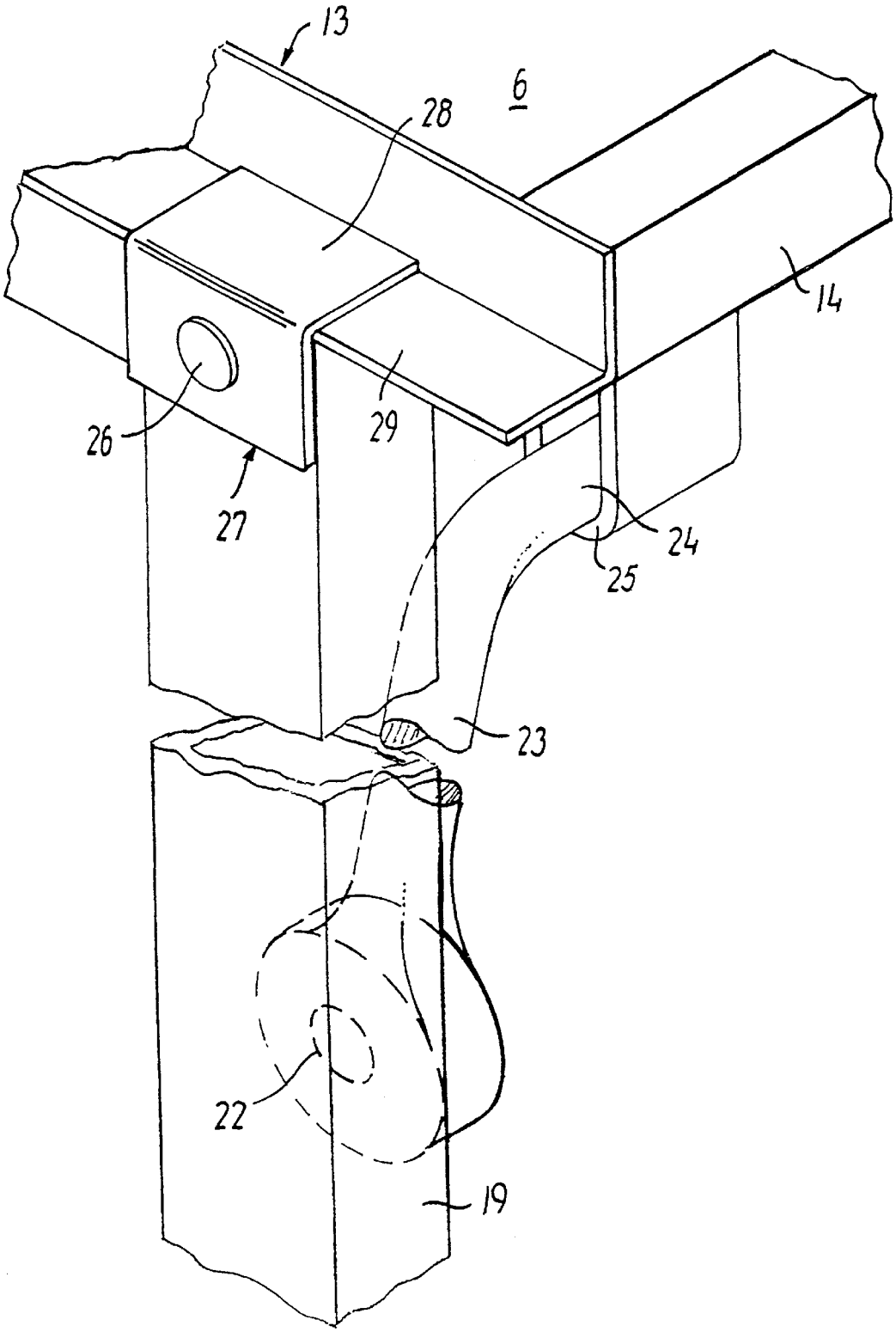
FIG. 10 is on a larger scale a fractional view from the side of a pivot connection for the container in FIGS. 1–9.

The top wall 6 in FIG. 9 is constructed as a bar frame 11 with plate-shaped panels 12. The frame 11 consists in itself of two angular side bars 13, two end bars 14 and two central bars 15 with a handle 16.

As seen in FIG. 9, two angular catches 17 are furthermore placed on the front end bar 14 and as it can be seen best in FIGS. 3–8, two other angular catches 18 are placed topmost on the left side wall 4.

Figure 8:
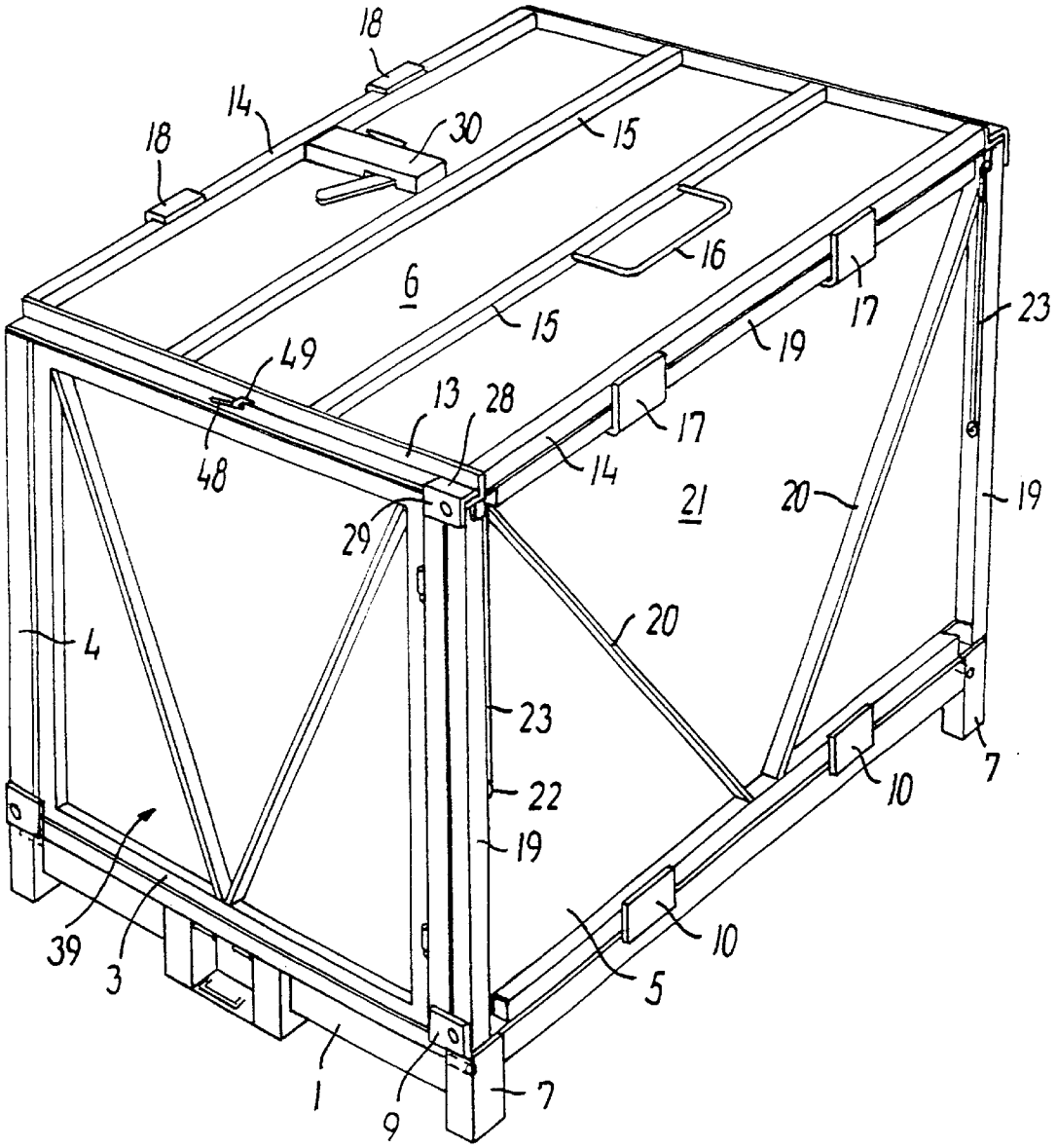
FIG. 8 shows the completely unfolded and assembled container.

The side walls 4 and 5 are, as shown in FIG. 8, constructed of a square bar frame 19, obliquely placed reinforcing bars 20, and plate-shaped panels 21.

In the middle of each of the two vertical bars of the square bar frame 19 of the right side wall 5 is furthermore placed guide rods 23 pivotal about a swivel pin 22 and with a bent end 24 opposite the swivel tap 22 engaging an oblong clamp 25 fastened on the underside of the top wall 6. The bent end 24 of the swivel pin fits the clamp 25 but with a clearance in the longitudinal direction.

On each of the upper comers of the right side wall S and pivotally about a swivel pin 26 is placed an angular pivoting guide 27, the upper flange 28 of which grasps in over the lower, projecting flange 29 of the angular side bar 13 (FIGS. 2–8).

Figure 6:
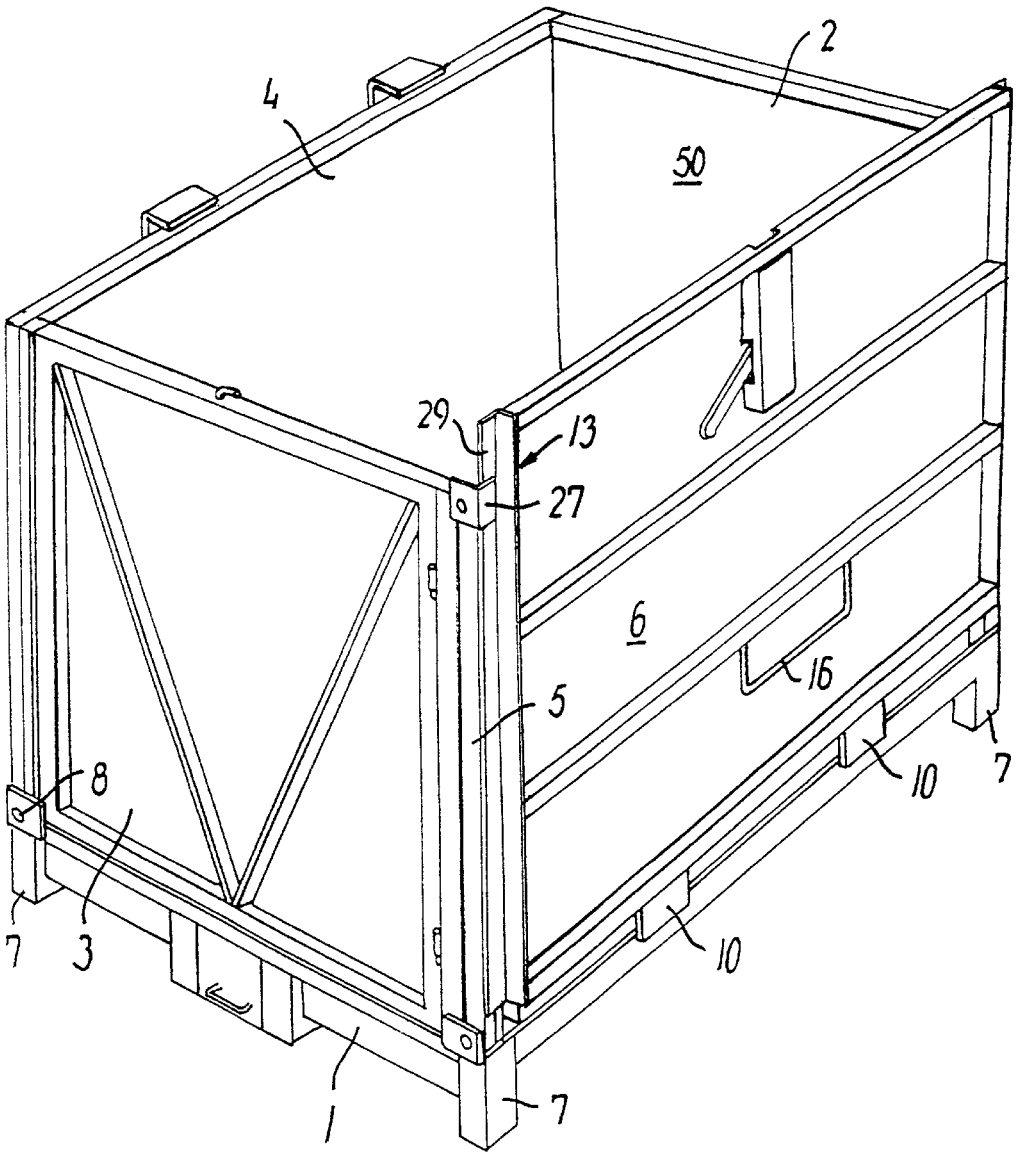
FIG. 6 shows the collapsible container in FIG. 1 in a fifth unfolding phase.

In FIG. 6, the top wall 6 is hanging in guide rods 23 along the exterior of the right side wall 5, the top wall being kept in position at the top by the grasp of the pivoting guide 27 around the lower flange 29 on the angular side bar 13 of the top wall.

Figure 7:
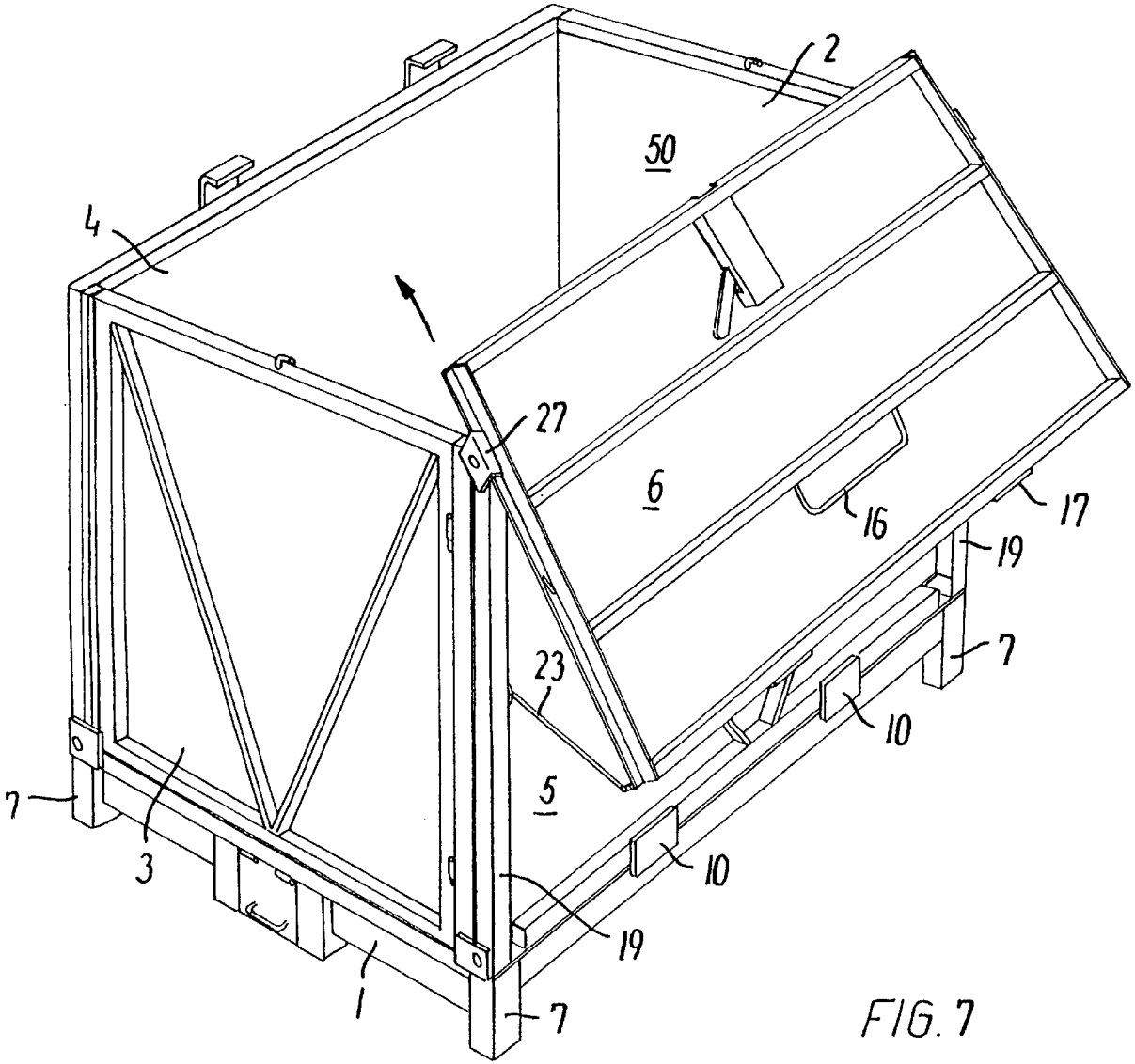
FIG. 7 shows the collapsible container in FIG. 1 in a sixth unfolding phase.

In FIG. 7, the assembler (not shown) has with a grip in the handle 16 lifted up the top wall 6 which during this is guided in its movement by the guide rod 23 and the angular pivoting guide 27. The lower end of the top wall is describing a circular arc while the rest of the top wall is being swung upwardly in the direction of the arrow at the same time as it is pushed further and further in between the pivoting guides 27.

In FIG. 8, the top wall 6 is now completely in position. The top wall is now in its final position in which it locks the upright ends 2, 3 and the side walls 4,5 and closes the container at the top.

The locking takes place in the following way.

In the final combined pivoting and displacing movement of the top wall, the foremost of the end bars 14 of the top wall is pushed in under the upper flange on the angular catches 18 topmost on the left side wall 4. At the same time, the catches 18 create a stop to further displacement of the top wall.

The lower flange on the two angular catches 17 on the rearmost end bar 14 of the top wall furthermore grasps below the upper bar on the square bar frame 19 of the right side wall 5. Just as the catches 17, the catches 18 create a stop for further displacement of the top wall.

A lock 30 of any expedient kind serves for keeping the top wall in the opposite direction of the above-mentioned direction in relation to the rest of the container. The lock can be arranged in such a way that it upon locking advantageously pulls the side walls 4 and 5 firmly together.

In the lower, projecting flange 29 on each angular side bar 13 of the top wall 6 is made a slot 48 that is extending obliquely outwards in relation to the direction in which the top wall is moving upon assembling of the container.

On the top side of each end 2 and 3 is placed a catch 49 engaging, as shown in FIG. 8, the slots 48 in the final assembling movement of the top wall. Due to the oblique position of the slots, the ends are pulled firmly together.

As it can be seen, the container according to the invention has been raised in the above manner quickly and easily from a collapsed position in which it occupies very little space. This allows for the container to be transported conveniently and economically to the unfolded position in which its walls are effectively locked together and are forming a solid support for a flexible liner filled with a liquid.

When the liner has been emptied, the container can just as easily and quickly be collapsed again by carrying out the above operations in reverse order. During this, the assembler first unlocks the lock 30 and then starts pulling the top wall back in a mainly almost translatory, horizontal movement. As mentioned above, the engagement of the guide rod 23 with the back end of the top wall via the oblong clamp 25 will cause this end to describe a circular movement. As the bent end 24 of the guide rod is displaceable a distance in the oblong clamp, the above translatory movement is however allowed initially before the engagement between the guide rod and the top wall effectively starts functioning and then forces the rear end of the top wall to follow a circular path in a guided manner. Thereby, the initial operation of collapsing the top wall down along the corresponding side wall is facilitated. The same advantage is obtained when the top wall in the terminal phase is pushed in position on told of the container.

The back end 2 is, as shown in FIG. 5, just as the side walls 4 and 5 constructed of a square bar frame 31, obliquely placed reinforcing bars (not shown in the figure) and plate-shaped panels 50.

The liquid in the liner influences the ends 2 and 3, together with the side walls 4 and 5 with a considerable pressure from within. In order to avoid the ends bending out, the two vertical bars—seen in the raised position of the container—on the bar frame 31 of the end are each provided with two projecting bolt clamps 32 each having a shank 33 and a head 34.

Figure 11:
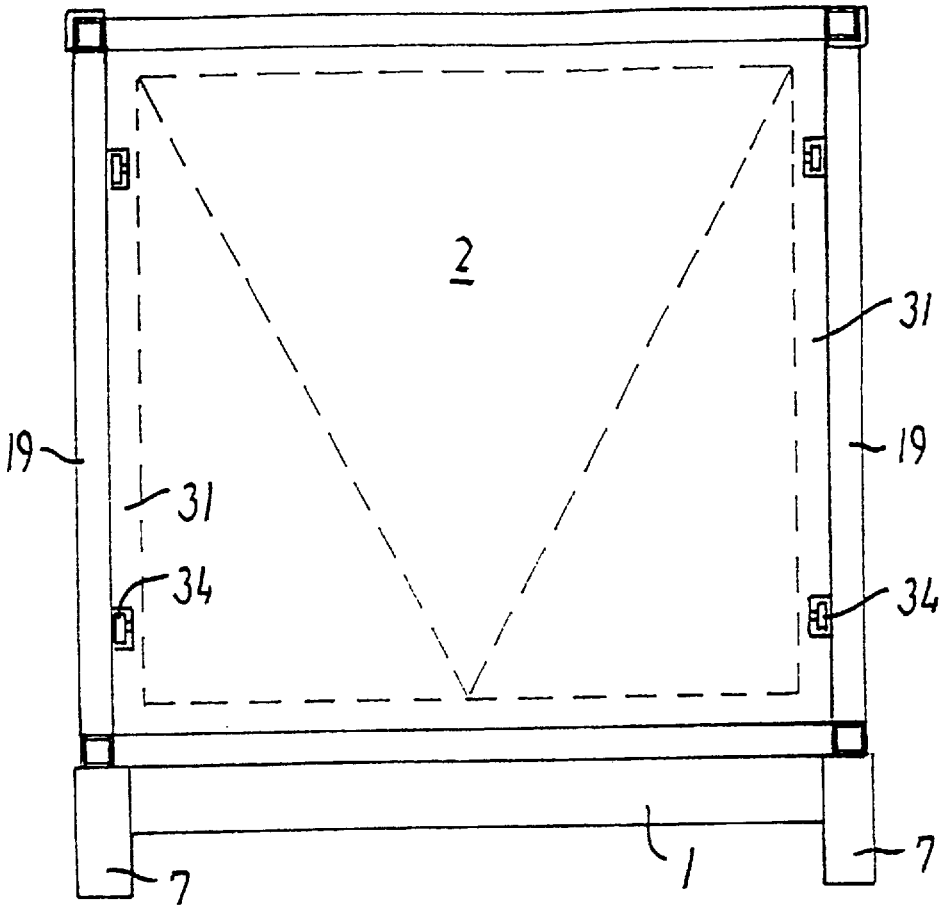
FIG. 11 is a plane view from within of an end of the container.
Figure 12:
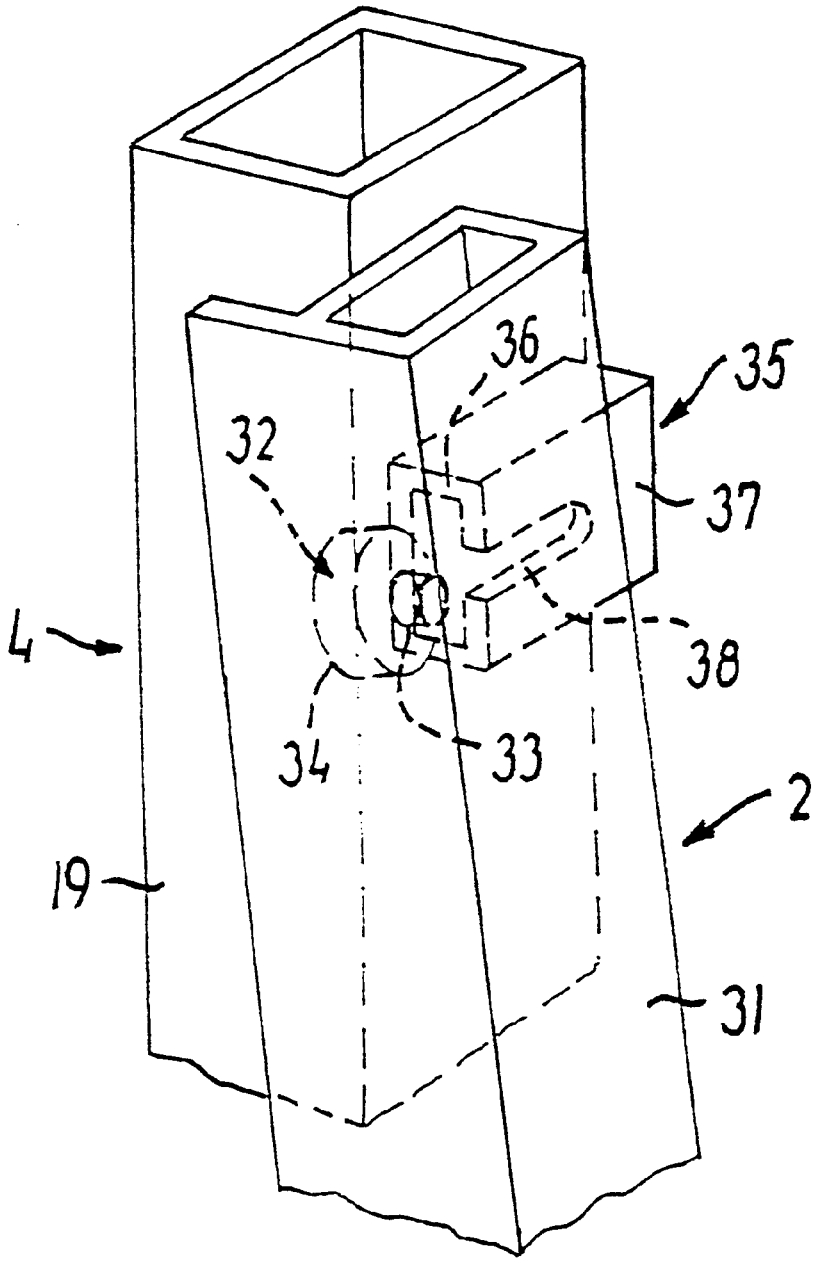
FIG. 12 is on a larger scale a perspective, fractional view of an arrangement for locking two of the walls of the collapsible container together.

These details are best seen in FIG. 11 that shows the container from within facing the back end 2, and in FIG. 12 that shows a fragment of the adjacent vertical bars on the bar frames 19 and 31 on the left side wall 4 and the end 2 respectively.

As it can be seen, a U-shaped locking catch 35 with legs 36 fastened on the bar 19 and a bottom 37 with a slot 38 fitting the bolt clamp 32 are placed on the vertical bar 19 of the side wall 4.

When the end 2 is swung between the upright side walls 4 and 5, as shown in FIG. 5, the shank 33 of the bolt clamp 32 slides into the slot of the locking catch 35 while the head 34 of the bolt clamp catches behind the bottom 37 of the locking catch. In this position, the bolt clamp and the locking catch are held together in a detachable manner by means of a ball catch or similar locking means (not shown).

The shank can maximally be pushed to the bottom in the slot, and the locking catch cannot be pulled free of the head of the bolt. Thereby, the end and the side wall are locked firmly together so that they are prevented from bending out under the influence of the pressure of the liquid in a full liner.

As mentioned above, both the ends and the side walls are folded in over the base frame, and in their upright position, they are locked together in order to be able to absorb the pressure acting from within.

This arrangement is especially advantageous with regard to strength and results at the same in the fact that the container quickly and easily can be raised and collapsed into a position in which it occupies the least possible space.

However, it is a disadvantage that it is inconvenient and difficult for an assembler to having to reach across the pivotal ends or side walls in order to put up a liner.

This disadvantage is rectified by putting a door 39 in the front end 3 or the door end 3 in a way which is characteristic of the invention and which is described below with reference to FIG. 8, and FIGS. 13–17.

Figure 13:
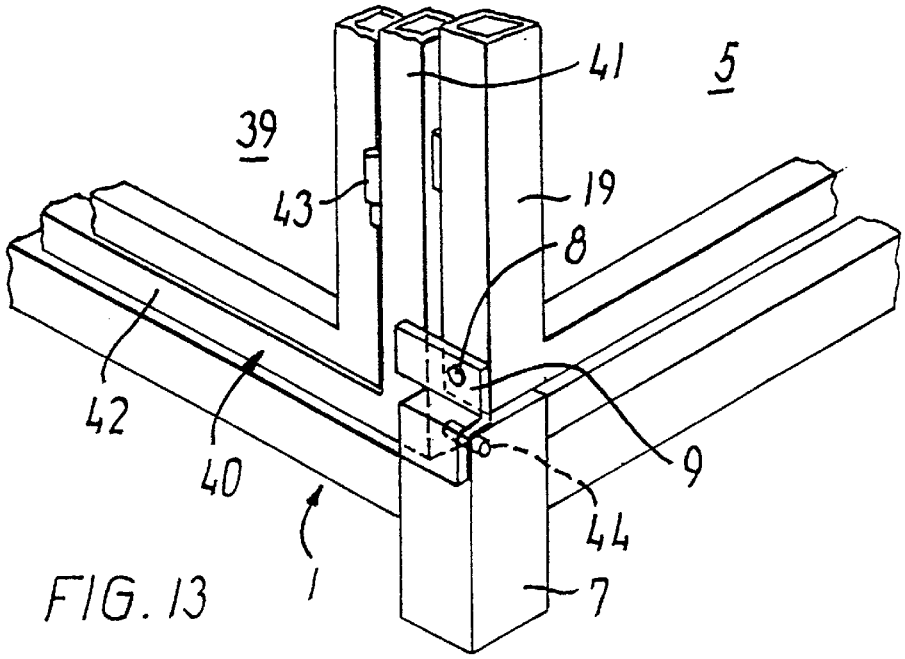
FIG. 13 is on a larger scale a perspective, fractional view of a pivotal arrangement of bearings of an end and -the adjacent side wall, respectively.

In the shown case, the door end 3 is constructed of the door 39 and an L-shaped bar 40 having a vertical leg 41 and a horizontal leg 42. The door 39 is with hinges. 43 pivotally mounted on the vertical leg 41 of the L-shaped bar 40 while the horizontal leg 42 of the bar 40, as shown in FIG. 13, is journaled pivotally about a horizontal axis in the leg 7 of the base frame 1 by means of swivel pins 44. At the same time, the bar frame 19 of the side wall 5 is, as mentioned above by means of swivel pins 8 and pivotally about a second horizontal axis, journaled in bearing brackets 9 fastened on the leg of the base frame.

As it can be seen in FIG. 13, the swivelling axis of the door end is placed a distance below the swivelling axis of the side walls. The size of this distance between the two swivelling axes is preferably chosen so that the side wall will lie closely across and parallel to the door end in the collapsed state of the container. When the size of the distance between the swivelling axes of two opposite side walls/ends moreover is chosen in the same way, the collapsed container will occupy the least possible space in the height.

Figure 14:
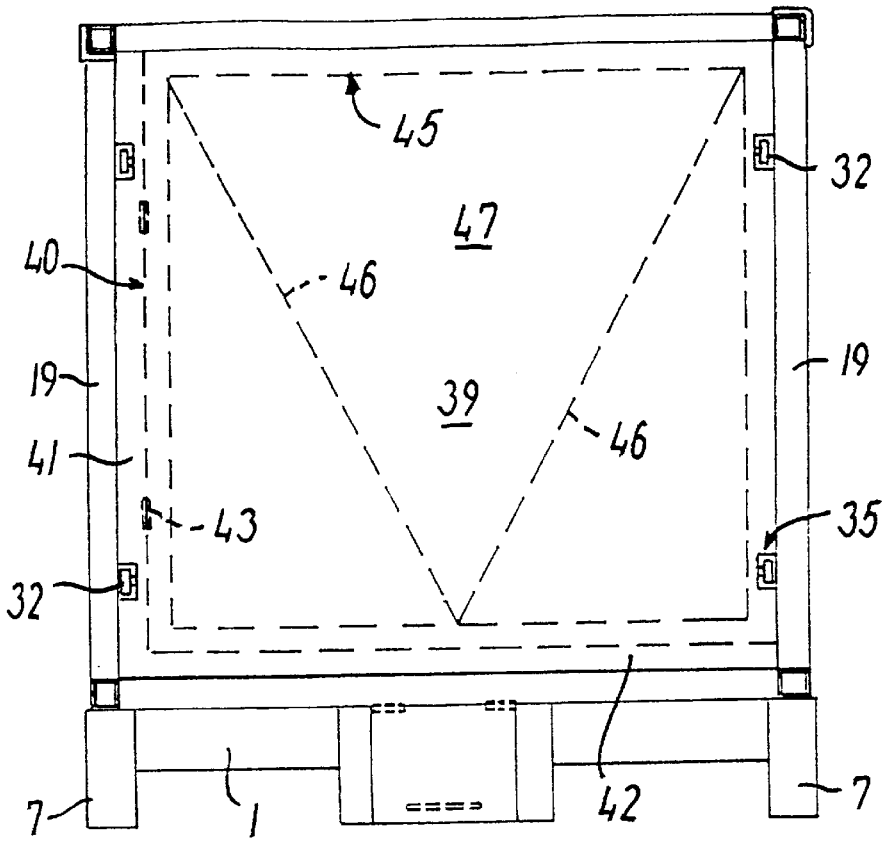
FIG. 14 is a plane view from within of a second end of the container, equipped with a door.

The door end 3, shown from within in FIG. 14, is constructed of a square bar frame 45, obliquely placed reinforcing bars 46, and plate-shaped panels 47. In this case, the bolt clamps 32 on the left side are placed on the L-shaped bar 40 of the door end while the bolt clamps 32 on the right side are placed on the bar frame 45 of the door 39.

The bolt clamps 32 on the bar frame 45 and the door 39 respectively ensure by means of their engagement with the U shaped locking catches 35 on the side walls 4 and 5 in the unfolded position in FIG. 8 that the door end 3 can absorb the outwardly acting pressure of the liquid in the liner. However, the door cannot at the same time be opened outwardly and thereby give an assembler access to put up the liner.

Figure 15:
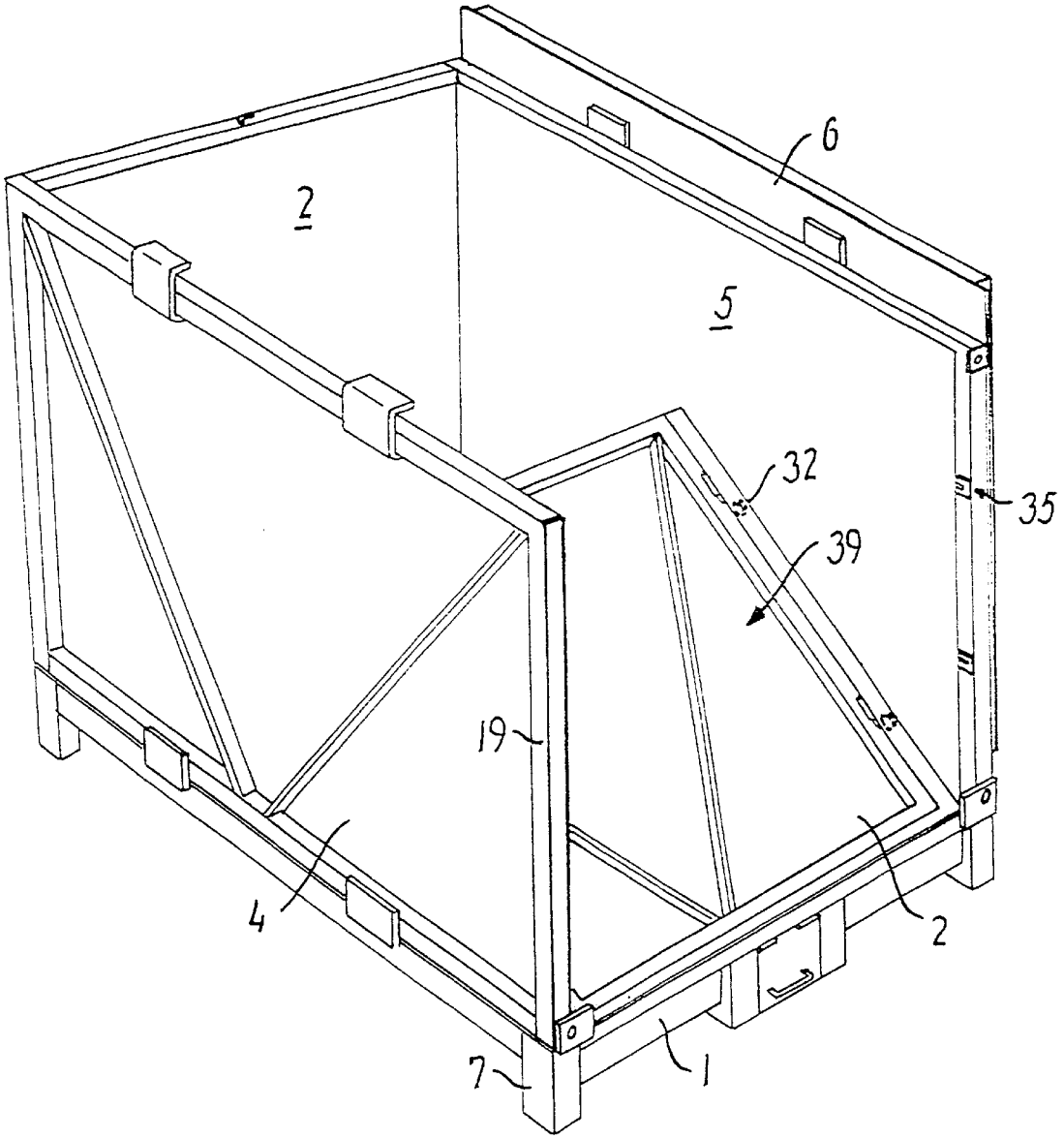
FIG. 15 is a perspective view of an initial phase of opening of the door in FIG. 14.
Figure 16:
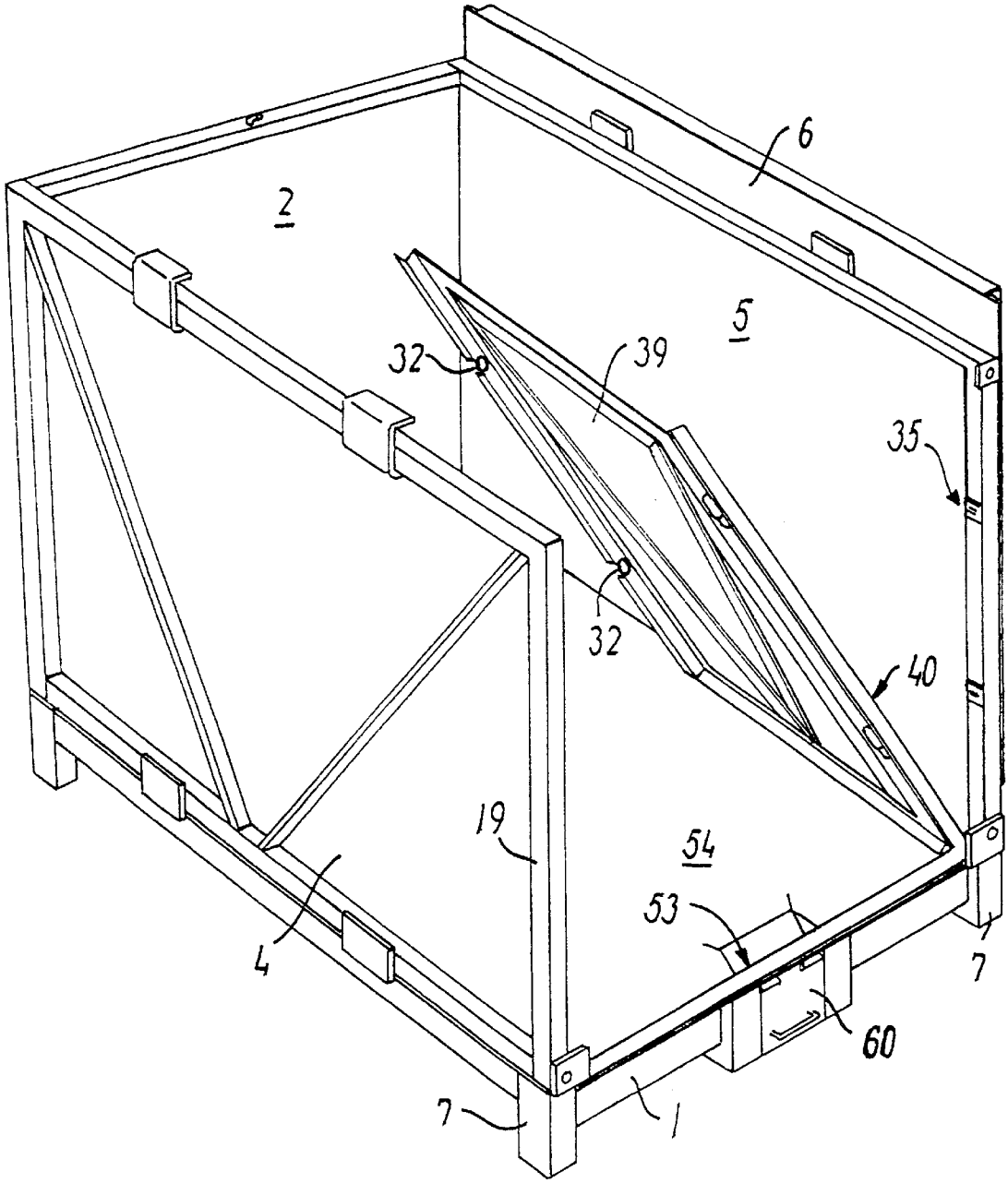
FIG. 16 shows the same operation in FIG. 15 in a second phase.
Figure 17:
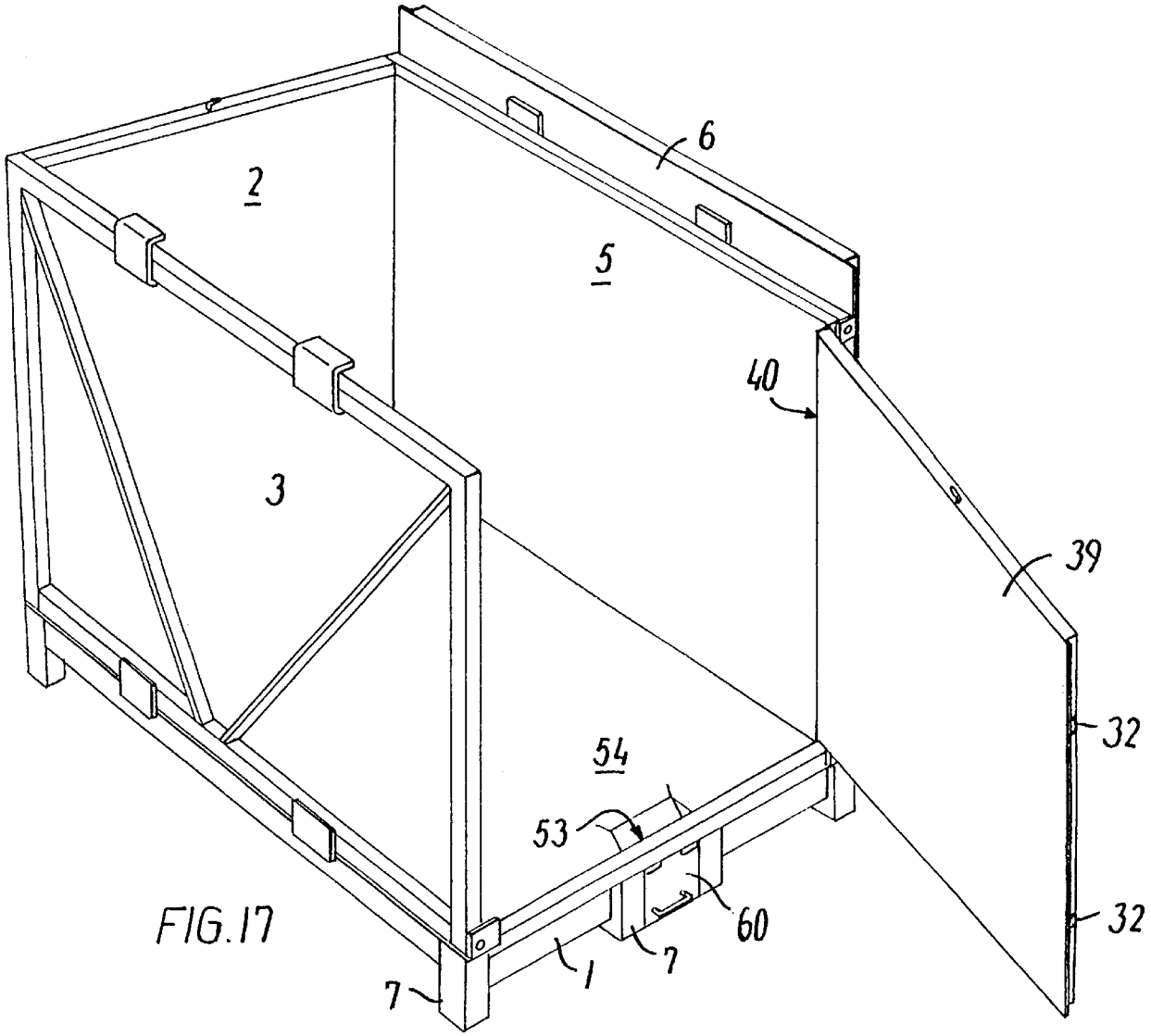
FIG. 17 shows the same operation in FIG. 15 in a third phase.

When the top wall 6 is in the position shown in FIG. 6 in which it is hanging down along the right side wall 5, the door 39 can however be opened only in the way shown in FIGS. 15, 16 and 17.

In FIG. 15, the door end 3 is swung inwardly about its horizontal swivelling axis between the side walls 4 and 5. In this position, the bolt clamps 32 on the door 39 are disengaged from the locking catches 35 on the bar frame 19 of the left side wall 4, and the door 39 can therefore now, as shown in FIG. 16, be swung outwardly in relation to the L-shaped frame 40 of the door end about the hinges 43 and during this pass the frame 19 of the side wall 4 with the locking catches 35 when the angle which the door end 3 is swung inwardly is sufficiently large, e.g. about 300.

In FIG. 17, the frame 40 of the door end is again swung up into upright position after which the door 39 can be opened in a normal way about a vertical swivelling axis. Now, the assembler can directly assemble the connecting piece 52 of the liner 51 in a lower exit opening 53 in the base frame 1.

Figure 19:
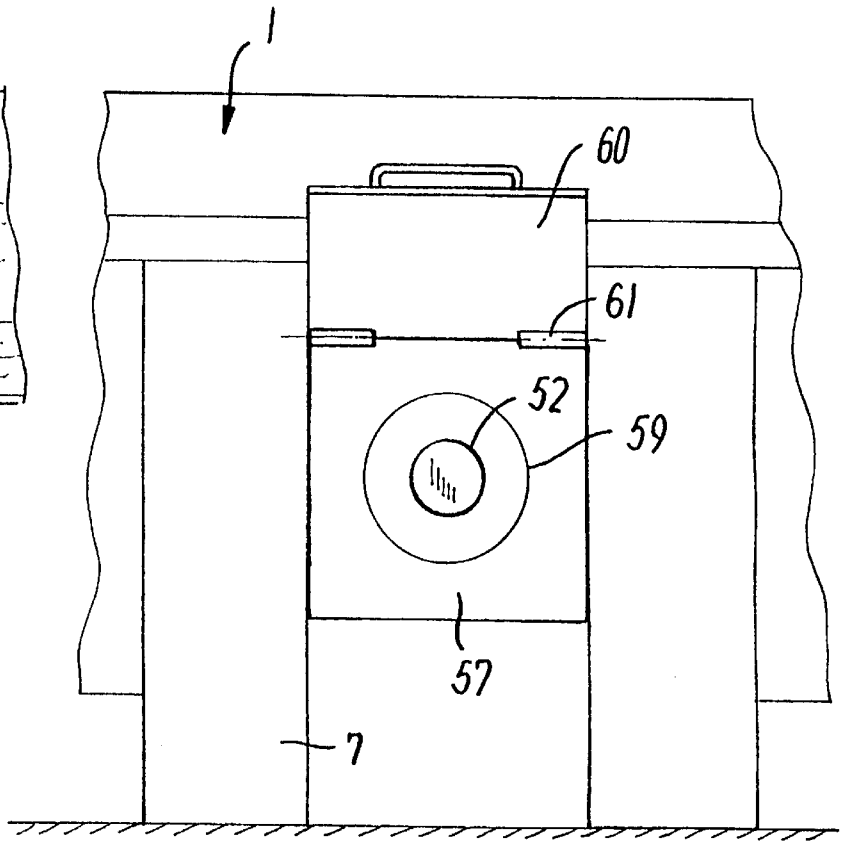
FIG. 19 is a front view of the base frame in FIG. 18.
Figure 18:
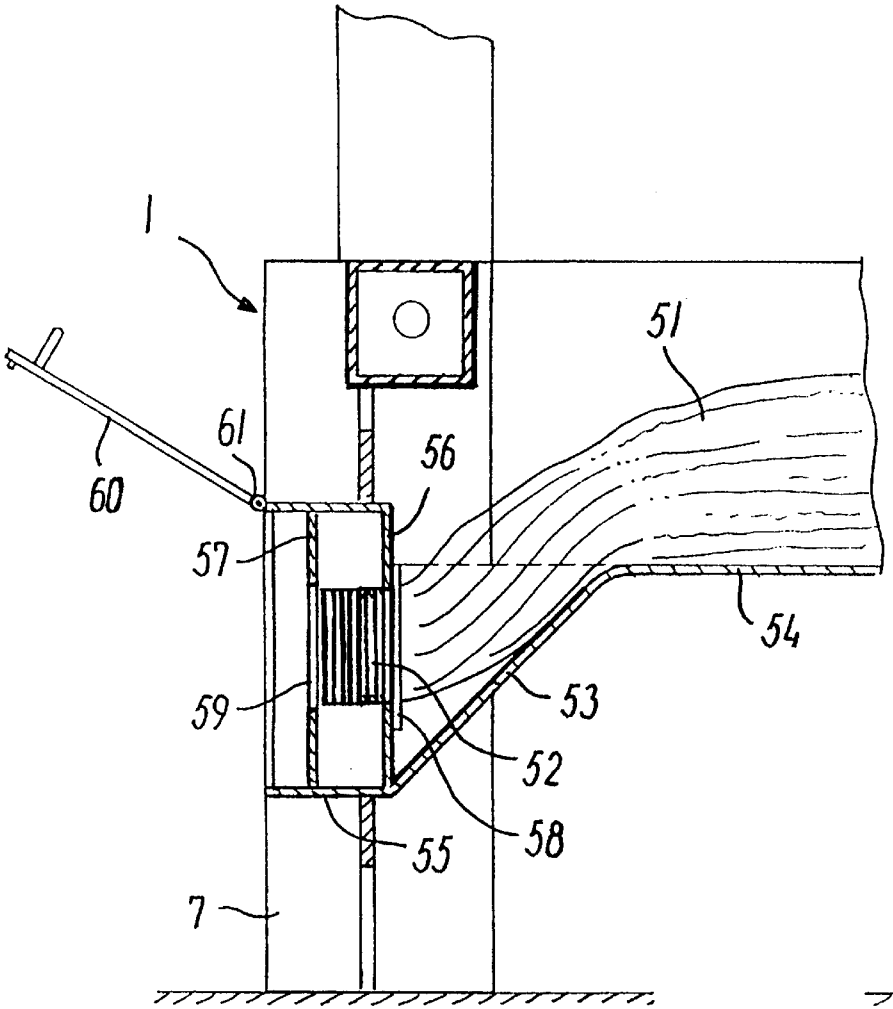
FIG. 18 is on a larger scale a fractional, sectional view of the base frame under the door.

FIGS. 18 and 19 show a fragment in section and from in front respectively of the part of the base frame 1 that is under the door 39 of the door end 3.

The assembler has, via the door 39 which has been opened in the way shown in FIGS. 15–17 and described above, put the empty liner 51 in on the bottom 54 of the base frame. The bottom is at the exit opening 53 inclining somewhat downwards to allow for the connecting piece 52 to conveniently be led out through the exit opening.

The exit opening is constructed in a casing 55 placed on the base frame 1 and having an interior wall 56 and an exterior wall 57. These walls 56,57 are placed with such a big mutual spacing that the connecting piece 52 can fit inside the casing when a flange 58 on the liner is made to abut against the interior wall 56.

In the exterior wall 57 of the casing is an exterior opening 59 through which access can be gained to the connecting piece 52 of the liner when the liner is to be filled and emptied. The connecting piece 52 can e.g. be a threaded connecting piece for being connected with a screwed joint on a hose (not shown).

During transport and storage, the exterior opening 59 of the casing is closed with an overhanging shutter 60, which can swing about a horizontal swivelling axis by means of hinges 61.

The embodiment described above and shown in the drawing of a collapsible container according to the invention is only to be taken as an example.

The top wall can thus be constructed and pivotally connected to a side wall or end in any other expedient way. Thus, the top wall can e.g. consist of two hinged sections, one of which is additionally hinged to a side wall or end.

The side walls and end can also be constructed in another way than the one mentioned, and the locking of the completely raised container can be done with other locking means than the ones described.

Thus, the door end can have a rectangular bar frame instead of an L-shaped bar for hinging of the door whereby all the bolt clamps are placed on this frame.

The collapsible container according to the invention is especially suited for containing a liner for storing and transporting a liquid but it can obviously also be used for storing and transporting solid goods, the top wall is then swung free of the container top opening which is used for loading and unloading the goods.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. Collapsible container comprising a base section;

two end sections;

two side sections, wherein the two opposite end sections and the two opposite side sections are pivotally connected to the base section;

a top section pivotally connected to one of the side sections or one of the end sections;

a liner, wherein the base, end, side and top sections are arranged to pivot in relation to each other between a first position in which they are extending in substantially parallel rows across each other and a second position in which they jointly are defining a chamber for containing the liner;

locking mechanism configured and dimensioned to lock the end sections and the side sections together in the second position so that they can only be pivoted in over the base section, wherein at least one of the end sections is constructed as a door section partly consisting of an L-shaped frame connected pivotally about a swivelling axis to the base section;

and partly at least one door connected pivotally about a second swivelling axis to the L-shaped frame, wherein the L-shaped frame of the door section has a first leg pivotally mounted on the base section and a second leg connected to the door by means of hinges and that at least one first stop is placed on the door section on the second leg of the L-shaped frame and at least one second stop on a lateral edge of the door opposite the second leg.

2. The collapsible container of claim 1, wherein the locking mechanism includes at least one first stop on each end section and at least one second stop shaped complementary to the first stop on each of the side sections, and the at least one first and the at least one second stop are arranged to engage each other in the second position and are disengaged by swinging the end section in the direction of the first position of the end section.

3. The collapsible container of claim 1, wherein the at least one first stop is shaped as a bolt with a shank and a head, and the at least one second stop is shaped as a locking plate with a slot, and that the at least one first and second stops are arranged in such a way that the shank of the bolt will be in the slot and its head behind the locking plate when the respective sections are in the second position.

4. The collapsible container of claim 3, wherein the at least one second stop is constructed in a U fastened with the legs on the inside of the respective side section and that a bottom of the U forms the locking plate with the slot.

5. The collapsible container of claim 1, wherein the base section has a number of pivot stop s extending a distance along an exterior of the end sections and the side sections when the end and side sections are in the second position.

6. The collapsible container of the claim 1, wherein the top section is pivotally placed on the side section that adjoins the second leg on the L-shaped frame of the door section.

7. The collapsible container of claim 1, wherein the side sections are connected pivotally about a swivelling axis to the base section, and the swivelling axis of the side sections is at a greater distance from the base frame than the swivelling axis of the end sections.

8. The collapsible container according to claim 1, wherein the base section is constructed as a pallet with a bottom, and that in the base section under the door section is an exit opening for a connecting piece on the liner.

9. The collapsible container according to claim 1, wherein the base section is substantially rectangular.

* * * * *